US008564629B2

(12) United States Patent
Toyotaka et al.

(10) Patent No.: US 8,564,629 B2
(45) Date of Patent: Oct. 22, 2013

(54) LIQUID CRYSTAL DISPLAY DEVICE AND DRIVING METHOD THEREOF

(75) Inventors: Kouhei Toyotaka, Atsugi (JP); Hiroyuki Miyake, Atsugi (JP)

(73) Assignee: Semiconductor Energy Laboratory Co., Ltd., Atsugi-shi, Kanagawa-ken (JP)

( * ) Notice: Subject to any disclaimer, the term of this patent is extended or adjusted under 35 U.S.C. 154(b) by 335 days.

(21) Appl. No.: 13/112,338

(22) Filed: May 20, 2011

(65) Prior Publication Data

US 2011/0292088 A1 Dec. 1, 2011

(30) Foreign Application Priority Data

May 25, 2010 (JP) ..... 2010-119070
Aug. 16, 2010 (JP) ..... 2010-181500
Dec. 17, 2010 (JP) ..... 2010-281575

(51) Int. Cl.
*G09G 5/10* (2006.01)
*G09G 3/36* (2006.01)

(52) U.S. Cl.
USPC ..... 345/690; 345/204; 345/102

(58) Field of Classification Search
None
See application file for complete search history.

(56) References Cited

U.S. PATENT DOCUMENTS 4,901,066 A * 2/1990 Kobayashi et al. ..... 345/94
6,448,951 B1 9/2002 Sakaguchi et al.
6,882,012 B2 4/2005 Yamazaki et al.
7,193,593 B2 3/2007 Koyama et al.
7,224,339 B2 5/2007 Koyama et al.
7,268,756 B2 9/2007 Koyama et al.
7,317,438 B2 1/2008 Yamazaki et al.
7,385,579 B2 6/2008 Satake
7,425,937 B2 9/2008 Inukai
7,903,076 B2 * 3/2011 Hsu ..... 345/100
2005/0083319 A1 * 4/2005 Kodate et al. ..... 345/204
2008/0129652 A1 * 6/2008 Park ..... 345/55

(Continued)

FOREIGN PATENT DOCUMENTS

JP 11-337904 A 12/1999
JP 2001-142140 A 5/2001

(Continued)

OTHER PUBLICATIONS

Baron et al., "36.4: Can Motion Compensation Eliminate Color Breakup of Moving Objects in Field-Sequential Color Displays?" SID Digest '96: SID International Symposium Digest of Technical Papers, 1996, vol. 27, pp. 843-846.

(Continued)

*Primary Examiner* — Christopher R Lamb
(74) *Attorney, Agent, or Firm* — Eric J. Robinson; Robinson Intellectual Property Law Office, P.C.

(57) ABSTRACT

A liquid crystal display device capable of performing image signal writing and display with a field-sequential method in parallel, with a simple pixel configuration. In the liquid crystal display device, image signal writing to pixels in a row can be followed by image signal writing to pixels in a row which is separate from the row by at least two rows. Therefore, in the liquid crystal display device, image signal writing and lighting of the backlights are not performed per pixel portion but can be performed per unit region of the pixel portion. Accordingly, image signal writing and lighting of the backlight can be performed in parallel in the liquid crystal display device.

18 Claims, 11 Drawing Sheets

(56) References Cited

U.S. PATENT DOCUMENTS

| | | | |
|---|---|---|---|
| 2011/0157216 | A1 | 6/2011 | Yamazaki et al. |
| 2011/0157253 | A1 | 6/2011 | Yamazaki et al. |
| 2011/0175873 | A1 | 7/2011 | Miyake |
| 2011/0175941 | A1 | 7/2011 | Miyake et al. |
| 2011/0241011 | A1 | 10/2011 | Koyama et al. |
| 2011/0242071 | A1 | 10/2011 | Koyama et al. |
| 2011/0242100 | A1 | 10/2011 | Yamazaki et al. |
| 2011/0248970 | A1 | 10/2011 | Koyama et al. |
| 2011/0248978 | A1 | 10/2011 | Koyama et al. |
| 2011/0249037 | A1 | 10/2011 | Koyama et al. |
| 2011/0249038 | A1 | 10/2011 | Yamazaki et al. |

FOREIGN PATENT DOCUMENTS

| | | | |
|---|---|---|---|
| JP | 2002-077932 | A | 3/2002 |
| JP | 2002-366118 | A | 12/2002 |
| JP | 2006-178126 | A | 7/2006 |
| JP | 2006-220685 | | 8/2006 |
| JP | 2006-220685 | A | 8/2006 |
| JP | 2007-264211 | | 10/2007 |
| JP | 2009-042405 | | 2/2009 |
| JP | 2009-042405 | A | 2/2009 |
| WO | WO-2006/067750 | | 6/2006 |

OTHER PUBLICATIONS

Kurita et al., "Evaluation and Improvement of Picture Quality for Moving Images on Field-sequential Color Displays," IDW '00: Proceedings of the 17th International Display Workshops, 2000, pp. 69-72.

Taira et al., "A 15" Field-Sequential Display without Color Break-Up using an AFLC Color Shutter," IDW '00: Proceedings of the 17th International Display Workshops, 2000, pp. 73-76.

Jarvenpaa, "7.2: Measuring Color Breakup of Stationary Images in Field-Sequential-Color Displays," SID Digest '04: SID International Symposium Digest of Technical Papers, 2004, vol. 35, pp. 82-85.

International Search Report (Application No. PCT/JP2011/061463) ated Jun. 21, 2011.

Written Opinion (Application No. PCT/JP2011/061463) Dated Jun. 21, 2011.

* cited by examiner

LIQUID CRYSTAL DISPLAY DEVICE AND DRIVING METHOD THEREOF

TECHNICAL FIELD

The present invention relates to a liquid crystal display device and a method for driving the liquid crystal display device. In particular, the present invention relates to a liquid crystal display device employing a field-sequential method and a method for driving the liquid crystal display device.

BACKGROUND ART

A color filter method and a field-sequential method are known as display methods of liquid crystal display devices. In a liquid crystal display device in which images are displayed by a color filter method, a plurality of subpixels each having a color filter that transmits only light with a wavelength of one color (e.g., red (R), green (G), or blue (B)) are provided in each pixel. A desired color is produced in such a manner that transmittance of white light is controlled per subpixel and a plurality of colors is mixed per pixel. On the other hand, in a liquid crystal display device in which images are displayed by a field-sequential method, a plurality of light sources that emit lights of different colors (e.g., red (R), green (G), and blue (B)) are provided. A desired color is produced in such a manner that the plurality of light sources sequentially turned on and transmittance of light of each color is controlled per pixel. In other words, a desired color is realized with division of the area of one pixel into respective areas for respective lights of colors according to the color filter method; a desired color is realized with division of the display period into respective display periods for respective lights of colors according to the field-sequential method.

The liquid crystal display device employing a field-sequential method has the following advantages over the liquid crystal display device employing a color filter method. First, in the liquid crystal display device employing a field-sequential method, it is not necessary to provide subpixels in each pixel. Thus, the aperture ratio can be improved or the number of pixels can be increased. In addition, in the liquid crystal display device employing a field-sequential method, it is not necessary to provide a color filter. That is, loss of light due to light absorption in the color filter does not occur. Therefore, light transmittance can be improved and power consumption can be reduced.

Patent Document 1 discloses a liquid crystal display device in which images are displayed by a field-sequential method. Specifically, Patent Document 1 discloses a liquid crystal display device in which each pixel includes a transistor for controlling input of an image signal, a signal storage capacitor for retaining the image signal, and a transistor for controlling charge transfer from the signal storage capacitor to a display pixel capacitor. In the liquid crystal display device having this configuration, image signal writing to the signal storage capacitor and display in accordance with electric charge retained in the display pixel capacitor can be performed in parallel.

REFERENCE

Patent Document 1: Japanese Published Patent Application No. 2009-042405

DISCLOSURE OF INVENTION

In liquid crystal display devices which have been generally used, a transistor for controlling an input of an image signal, a liquid crystal element having a liquid crystal whose orientation is controlled by application of a voltage in accordance with the image signal, and a capacitor for retaining a voltage applied to the liquid crystal element are provided to form each pixel. On the other hand, in the liquid crystal display device disclosed in Patent Document 1, the transistor for controlling charge transfer needs to be provided in addition to the above-described components of the pixel of the liquid crystal display devices. Further, a signal line for controlling ON/OFF of the transistor also needs to be provided. Therefore, the liquid crystal display device disclosed in Patent Document 1 has a problem of complexity of the pixel configuration as compared to conventional liquid crystal display devices.

An object of one embodiment of the present invention is to attain a liquid crystal display device capable of performing image signal writing and display with a field-sequential method in parallel, with a simple pixel configuration.

In order to achieve the above-described object, in a liquid crystal display device having a simple pixel configuration, image signal writing is performed to pixels sequentially not in the order of rows but every predetermined rows.

One embodiment of the present invention is a liquid crystal display device including a plurality of pixels arranged in a matrix of m rows by n columns (m and n each are a natural number greater than or equal to 2); 1st to m-th scan lines which are electrically connected to respective n pixels in their respective rows; 1st to n-th signal lines which are electrically connected to respective m pixels in their respective columns; a scan line driver circuit which is electrically connected to the 1st to m-th scan lines; and a signal line driver circuit which is electrically connected to the 1st to n-th signal lines. The scan line driver circuit includes 1st to m-th pulse output circuits which shift a shift pulse sequentially per shift period in response to a start pulse. An A-th pulse output circuit (A is a natural number less than or equal to m/2) has a 1st output terminal for outputting a shift pulse to the (A+1)-th pulse output circuit during an A-th shift period and a 2nd output terminal for outputting a selection signal to an A-th scan line in an A-th scan line selection period which overlaps with the A-th shift period. An (A+B)-th pulse output circuit (B is a natural number less than or equal to m/2) has a 1st output terminal for outputting a shift pulse to an (A+B+1)-th pulse output circuit during the A-th shift period and a 2nd output terminal for outputting a selection signal to an (A+B)-th scan line in an (A+B)-th scan line selection period which has a period which overlaps with the A-th shift period and a period which does not overlap with the A-th scan line selection period. The signal line driver circuit supplies a pixel image signal for an A-th row to the 1st to n-th signal lines in a period where the A-th shift period and the A-th scan line selection period overlap with each other, and supplies a pixel image signal for an (A+B)-th row to the 1st to n-th signal lines in a period of the (A+B)-th scan line selection period, where none of the A-th shift period and the A-th scan line selection period overlap with each other.

One embodiment of the present invention is a method for driving a liquid crystal display device where a plurality of light sources which emit light with respective different colors is sequentially turned on with respect to a pixel portion including a plurality of pixels arranged in a matrix of m rows by n columns (m and n each are a natural number greater than or equal to 2), and the transmittance of light is controlled per pixel to form an image on the pixel portion. In consecutive 1st to A-th shift periods (A is a natural number less than or equal to m/2), where image signals are supplied to the pixels in the 1st row and then image signals are supplied to the pixels in the (A+1)-th row in the 1st shift period, and similarly, image signals are supplied to the pixels in the A-th row and then image signals are supplied to the pixels in the 2A-th row in the A-th shift period, the light sources for the 1st to B-th rows and the light sources for the (A+1)-th to (A+B)-th rows are turned on after the B-th shift period (B is a natural number less than A).

With a liquid crystal display device of one embodiment of the present invention, image signal writing to pixels in a row can be followed by image signal writing to pixels in a row which is separate from the row by at least two rows. Therefore, in the liquid crystal display device, image signal writing and lighting of the backlights are not performed per pixel portion but can be performed per unit region of the pixel portion. Accordingly, image signal writing and lighting of the backlight can be performed in parallel in the liquid crystal display device.

BEST MODE FOR CARRYING OUT THE INVENTION

Hereinafter, embodiments of the present invention will be described with reference to the accompanying drawings. However, the present invention can be carried out in many different modes, and it is easily understood by those skilled in the art that modes and details of the present invention can be modified in various ways without departing from the purpose and the scope of the present invention. Therefore, the present invention is not interpreted as being limited to the description of the embodiments below.

Liquid crystal display devices described below each can be applied to a liquid crystal display device with any liquid crystal mode. Specifically, a TN (twisted nematic) liquid crystal display device, a VA (vertical alignment) liquid crystal display device, an OCB (optically compensated birefringence) liquid crystal display device, an IPS (in-plane switching) liquid crystal display device, or an MVA (multi-domain vertical alignment) liquid crystal display device can be provided. Alternatively, liquid crystal exhibiting a blue phase for which an alignment film is unnecessary may be used. A blue phase is one of liquid crystal phases, which is generated just before a cholesteric phase changes into an isotropic phase while the temperature of cholesteric liquid crystal is increased. Since the blue phase is only generated within a narrow range of temperature, a chiral agent or an ultraviolet curable resin is added so that the temperature range is improved. The liquid crystal composition which includes a liquid crystal exhibiting a blue phase and a chiral agent has a short response time of greater than or equal to 10 μsec and less than or equal to 100 μsec, and has optical isotropy, which makes the alignment process unneeded, and has a small viewing angle dependence.

First, a liquid crystal display device according to one embodiment of the present invention will be described using FIGS. 1A and 1B, FIGS. 2A to 2C, FIGS. 3A to 3D, FIGS. 4A and 4B, FIG. 5, FIG. 6, FIGS. 7A and 7B, FIGS. 8A and 8B, FIG. 10, and FIG. 11.

<Structure Example of Liquid Crystal Display Device>

Figure 1A:
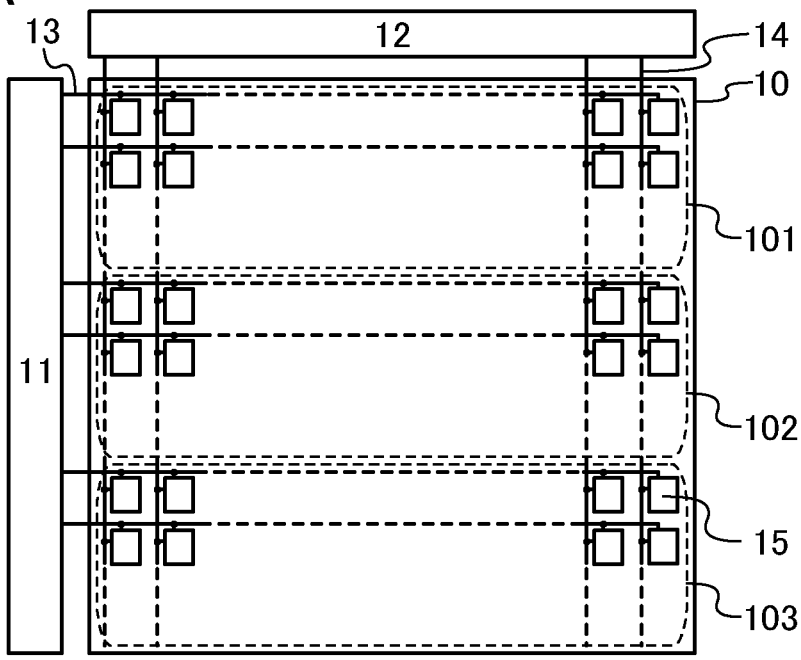
FIG. 1A illustrates a structure example of a liquid crystal display device.

FIG. 1A illustrates a structure example of a liquid crystal display device. The liquid crystal display device shown in FIG. 1A includes a pixel portion 10, a scan line driver circuit 11, a signal line driver circuit 12, m scan lines 13 arranged in parallel or in substantially parallel, whose potentials are controlled by the scan line driver circuit 11, and n signal lines 14 arranged in parallel or in substantially parallel, whose potentials are controlled by the signal line driver circuit 12. The pixel portion 10 is divided into three regions (regions 101 to 103), and each region includes a plurality of pixels arranged in a matrix. The scan lines 13 are electrically connected to respective n pixels in respective rows, among the plurality of pixels arranged in a matrix of m rows by n columns in the pixel portion 10. In addition, the signal lines 14 are electrically connected to respective m pixels in respective columns, among the plurality of pixels arranged in the matrix of the m rows by the n columns.

Figure 1B:
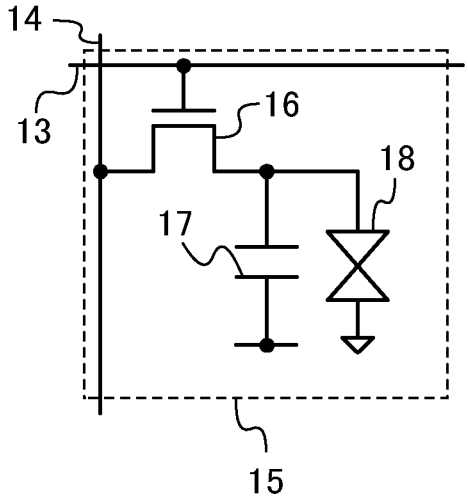
FIG. 1B illustrates a configuration example of a pixel.

FIG. 1B illustrates an example of a circuit configuration of a pixel 15 included in the liquid crystal display device illustrated in FIG. 1A. The pixel 15 in FIG. 1B includes a transistor 16, a capacitor 17, and a liquid crystal element 18. A gate of the transistor 16 is electrically connected to the scan line 13, and one of a source and a drain of the transistor 16 is electrically connected to the signal line 14. One of electrodes of the capacitor 17 is electrically connected to the other of the source and the drain of the transistor 16, and the other of the electrodes of the capacitor 17 is electrically connected to a wiring for supplying a capacitor potential (the wiring also referred to as a capacitor line). One of electrodes (also referred to as a pixel electrode) of the liquid crystal element 18 is electrically connected to the other of the source and the drain of the transistor 16 and the one of the electrodes of the capacitor 17, and the other of the electrodes (also referred to as a counter electrode) of the liquid crystal element 18 is electrically connected to a wiring for supplying a counter potential. The transistor 16 is an N-channel transistor in this embodiment. The capacitor potential and the counter potential can be equal to each other.

<Structure Example of Scan Line Driver Circuit 11>

Figure 2A:
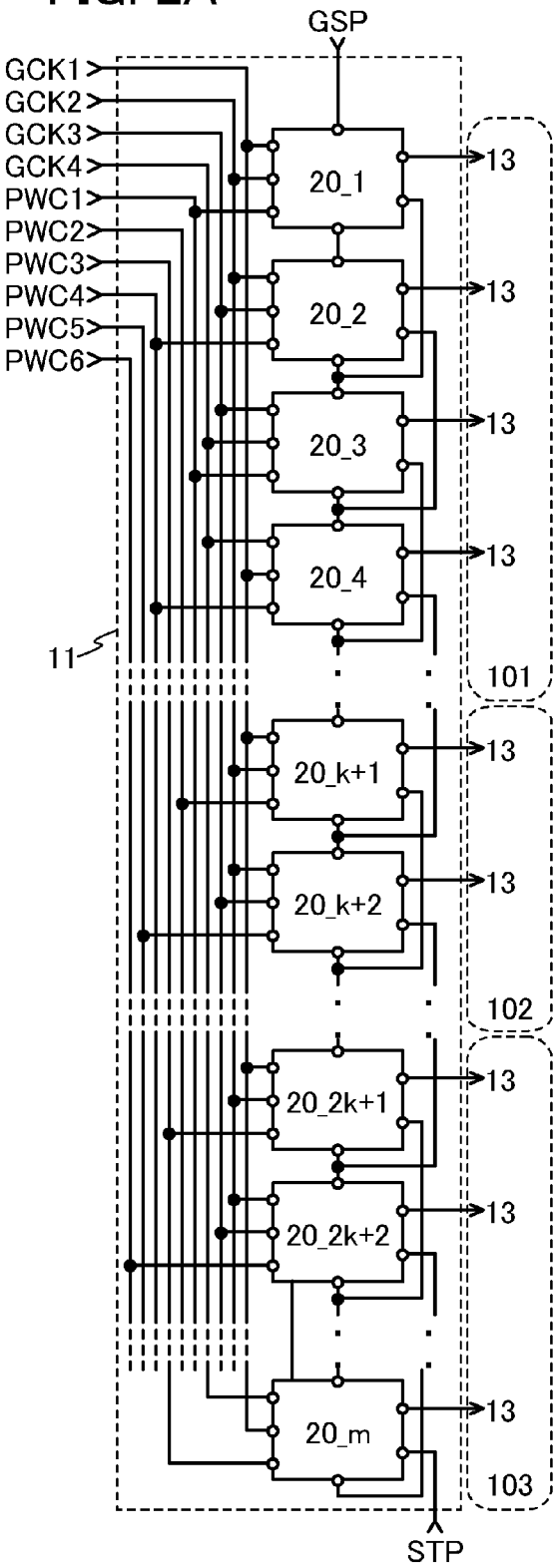
FIG. 2A illustrates a structure example of a scan line driver circuit.

FIG. 2A illustrates a structure example of the scan line driver circuit 11 included in the liquid crystal display device in FIG. 1A. The scan line driver circuit 11 shown in FIG. 2A includes: respective wirings for supplying 1st to 4th clock signals (GCK1 to GCK4) for the scan line driver circuit; respective wirings for supplying 1st to 6th pulse-width clock signals (PWC1 to PWC6); and a 1st pulse output circuit 20_1 which is electrically connected to the scan line 13 in the 1st row to a m-th pulse output circuit 20_*m* which is electrically connected to the scan line 13 in the m-th row. In this example, the 1st pulse output circuit 20_1 to the k-th pulse output circuit 20_*k* (k is less than m/2 and a factor of 4) are electrically connected to the scan lines 13 provided for the region 101; the (k+1)-th pulse output circuit 20_(k+1) to the 2k-th pulse output circuit 20_2k are electrically connected to the scan lines 13 provided for the region 102; and the (2k+1)-th pulse output circuit 20_(2k+1) to the m-th pulse output circuit 20_*m* are electrically connected to the scan lines 13 provided for the region 103. The 1st pulse output circuit 20_1 to the m-th pulse output circuit 20_*m* are configured to shift a shift pulse sequentially per shift period in response to a start pulse (GSP) for the scan line driver circuit which is input into the 1st pulse output circuit 20_1. A plurality of shift pulses can be shifted in parallel in the 1st pulse output circuit 20_1 to the m-th pulse output circuit 20_*m*. That is, even in a period in which a shift pulse is shifted in the 1st pulse output circuit 20_1 to the m-th pulse output circuit 20_*m*, the start pulse (GSP) can be input to the 1st pulse output circuit 20_1.

Figure 2B:
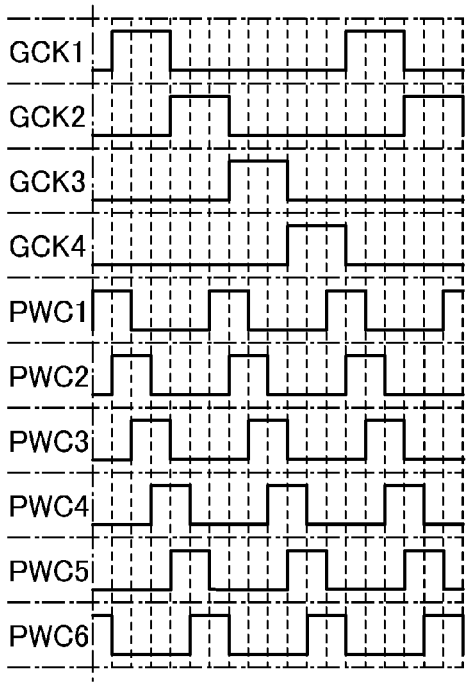
FIG. 2B is a timing chart showing an example of signals for a scan line driver circuit.

FIG. 2B illustrates an example of specific waveforms of the above-described signals. The 1st clock signal (GCK1) in FIG. 2B periodically repeats a high-level potential (high power supply potential (Vdd)) and a low-level potential (low power supply potential (Vss)), and has a duty ratio of 1/4. The 2nd clock signal (GCK2) is a signal whose phase is deviated by 1/4 period from the 1st clock signal (GCK1) for a scan line driver circuit; the 3rd clock signal (GCK3) is a signal whose phase is deviated by 1/2 period from the 1st clock signal (GCK1) for a scan line driver circuit; and the 4th clock signal (GCK4) is a signal whose phase is deviated by 3/4 period from the 1st clock signal (GCK1) for a scan line driver circuit. The 1st pulse-width control signal (PWC1) periodically repeats the high-level potential (high power supply potential (Vdd)) and the low-level potential (low power supply potential (Vss)), and has a duty ratio of 1/3. The 2nd pulse-width control signal (PWC2) is a signal whose phase is deviated by 1/6 period from the 1st pulse-width control signal (PWC1); the 3rd pulse-width control signal (PWC3) is a signal whose phase is deviated by 1/3 period from the 1st pulse-width control signal (PWC1); the 4th pulse-width control signal (PWC4) is a signal whose phase is deviated by 1/2 period from the 1st pulse-width control signal (PWC1); the 5th pulse-width control signal (PWC5) is a signal whose phase is deviated by 2/3 period from the 1st pulse-width control signal (PWC1); and the 6th pulse-width control signal (PWC6) is a signal whose phase is deviated by 5/6 period from the 1st pulse-width control signal (PWC1). In this example, the ratio of the pulse width of each of the 1st clock signal (GCK1) to the 4th clock signal (GCK4) to the pulse width of each of the 1st pulse-width control signal (PWC1) to the 6th pulse-width control signal (PWC6) is 3:2.

In the above-described liquid crystal display device, the same configuration can be applied to the 1st to m-th pulse output circuits 20_1 to 20_*m*. However, electrical connections of a plurality of terminals included in the pulse output circuit differ depending on the pulse output circuit. Specific connection relation will be described using FIGS. 2A and 2C.

Each of the 1st to m-th pulse output circuits 20_1 to 20_*m* has terminals 21 to 27. The terminals 21 to 24 and the terminal 26 are input terminals; the terminals 25 and 27 are output terminals.

First, the terminal 21 is described below. The terminal 21 of the 1st pulse output circuit 20_1 is electrically connected to a wiring for supplying the start signal (GSP). Respective terminals 21 of the 2nd to m-th pulse output circuits 20_2 to 20_*m* are electrically connected to respective terminals 27 of their respective previous-stage pulse output circuits.

Next, the terminal 22 is described below. The terminal 22 of the (4a−3)-th pulse output circuit (a is a natural number equal to or less than m/4) is electrically connected to the wiring for supplying the 1st clock signal (GCK1). The terminal 22 of the (4a−2)-th pulse output circuit is electrically connected to the wiring for supplying the 2nd clock signal (GCK2). The terminal 22 of the (4a−1)-th pulse output circuit is electrically connected to the wiring for supplying the 3rd clock signal (GCK3). The terminal 22 of the 4a-th pulse output circuit is electrically connected to the wiring for supplying the 4th clock signal (GCK4).

Next, the terminal 23 is described below. The terminal 23 of the (4a−3)-th pulse output circuit is electrically connected to the wiring for supplying the 2nd clock signal (GCK2). The terminal 23 of the (4a−2)-th pulse output circuit is electrically connected to the wiring for supplying the 3rd clock signal (GCK3). The terminal 23 of the (4a−1)-th pulse output circuit is electrically connected to the wiring for supplying the 4th clock signal (GCK4). The terminal 23 of the 4a-th pulse output circuit is electrically connected to the wiring for supplying the $1^{st}$ clock signal (GCK1).

Next, the terminal 24 is described below. The terminal 24 of the (2b−1)-th pulse output circuit (b is a natural number equal to or less than k/2) is electrically connected to the wiring for supplying the 1st pulse-width control signal (PWC1). The terminal 24 of the 2b-th pulse output circuit is electrically connected to the wiring for supplying the 4th pulse-width control signal (PWC4). The terminal 24 of the (2c−1)-th pulse output circuit (c is a natural number equal to or greater than k/2+1 and equal to or less than k) is electrically connected to the wiring for supplying the 2nd pulse-width control signal (PWC2). The terminal 24 of the 2c-th pulse output circuit is electrically connected to the wiring for supplying the 5th pulse-width control signal (PWC5). The terminal 24 of the (2d−1)-th pulse output circuit (d is a natural number equal to or greater than k+1 and equal to or less than m/2) is electrically connected to the wiring for supplying the 3rd pulse-width control signal (PWC3). The terminal 24 of the 2d-th pulse output circuit is electrically connected to the wiring for supplying the 6th pulse-width control signal (PWC6).

Next, the terminal 25 is described below. The terminal 25 of the x-th pulse output circuit (x is a natural number equal to and less than m) is electrically connected to the scan line 13 in the x-th row.

Next, the terminal 26 is described below. The terminal 26 of the y-th pulse output circuit (y is a natural number equal to and less than m−1) is electrically connected to the terminal 27 of the (y+1)-th pulse output circuit. The terminal 26 of the m-th pulse output circuit is electrically connected to a wiring for supplying a stop signal (STP) for the m-th pulse output circuit. In the case where a (m+1)-th pulse output circuit is provided, the stop signal (STP) for the m-th pulse output circuit corresponds to a signal output from the terminal 27 of the (m+1)-th pulse output circuit. Specifically, the stop signal (STP) for the m-th pulse output circuit can be supplied to the m-th pulse output circuit by the (m+1)-th pulse output circuit provided as a dummy circuit or by inputting the signal directly from the outside.

Relation of connection of the terminal 27 of each pulse output circuit is described above; thus, the above description is referred to.

<Structure Example of Pulse Output Circuit>

Figure 2C:
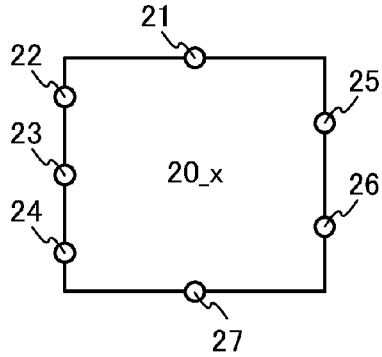
FIG. 2C illustrates a structure example of a pulse output circuit.
Figure 3A:
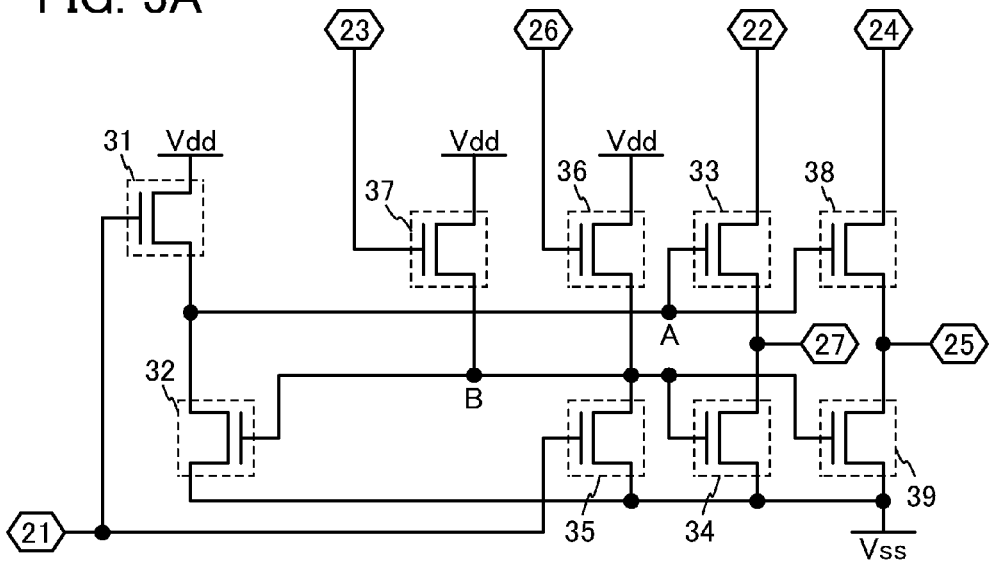
FIG. 3A is a circuit diagram illustrating an example of a pulse output circuit.

FIG. 3A illustrates a structure example of the pulse output circuit illustrated in FIGS. 2A and 2C. A pulse output circuit illustrated in FIG. 3A includes transistors 31 to 39.

One of a source and a drain of the transistor 31 is electrically connected to a wiring for supplying a high power supply potential (Vdd) (hereinafter the wiring also referred to as a high power supply potential line), and a gate thereof is electrically connected to the terminal 21.

One of a source and a drain of the transistor 32 is electrically connected to a wiring for supplying a low power supply potential (Vss) (hereinafter the wiring also referred to as a low power supply potential line), and the other of the source and the drain thereof is electrically connected to the other of the source and the drain of the transistor 31.

One of a source and a drain of the transistor 33 is electrically connected to the terminal 22, the other of the source and the drain thereof is electrically connected to the terminal 27, and a gate thereof is electrically connected to the other of the source and the drain of the transistor 31 and the other of the source and the drain of the transistor 32.

One of a source and a drain of the transistor 34 is electrically connected to the low power supply potential line, the other of the source and the drain of the transistor 34 is electrically connected to the terminal 27, and a gate thereof is electrically connected to a gate of the transistor 32.

One of a source and a drain of the transistor 35 is electrically connected to the low power supply potential line, the other of the source and the drain of the transistor 35 is electrically connected to the gate of the transistor 32 and the gate of the transistor 34, and a gate of the transistor 35 is electrically connected to the terminal 21.

One of a source and a drain of the transistor 36 is electrically connected to the high power supply potential line, the other of the source and the drain of the transistor 36 is electrically connected to the gate of the transistor 32, the gate of the transistor 34, and the other of the source and the drain of the transistor 35, and a gate of the transistor 36 is electrically connected to the terminal 26. The one of the source and the drain of the transistor 36 may be electrically connected to a wiring for supplying a power supply potential (Vcc) which is higher than the low power supply potential (Vss) and lower than the high power supply potential (Vdd).

One of a source and a drain of the transistor 37 is electrically connected to the high power supply potential line, the other of the source and the drain of the transistor 37 is electrically connected to the gate of the transistor 32, the gate of the transistor 34, the other of the source and the drain of the transistor 35, and the other of the source and the drain of the transistor 36, and a gate of the transistor 37 is electrically connected to the terminal 23. The one of the source and the drain of the transistor 37 may be electrically connected to the wiring for supplying the power supply potential (Vcc).

One of a source and a drain of the transistor 38 is electrically connected to the terminal 24, the other of the source and the drain of the transistor 38 is electrically connected to the terminal 25, and a gate of the transistor 38 is electrically connected to the other of the source and the drain of the transistor 31, the other of the source and the drain of the transistor 32, and the gate of the transistor 33.

One of a source and a drain of the transistor 39 is electrically connected to the low power supply potential line, the other of the source and the drain of the transistor 39 is electrically connected to the terminal 25, and a gate of the transistor 39 is electrically connected to the gate of the transistor 32, the gate of the transistor 34, the other of the source and the drain of the transistor 35, the other of the source and the drain of the transistor 36, and the other of the source and the drain of the transistor 37.

In the following description, a node where the other of the source and the drain of the transistor 31, the other of the source and the drain of the transistor 32, the gate of the transistor 33, and the gate of the transistor 38 are electrically connected to each other is referred to as a node A; a node where the gate of the transistor 32, the gate of the transistor 34, the other of the source and the drain of the transistor 35, the other of the source and the drain of the transistor 36, the other of the source and the drain of the transistor 37, and the gate of the transistor 39 are electrically connected to each other is referred to as a node B.

<Operation Example of Pulse Output Circuit>

Figure 3B:
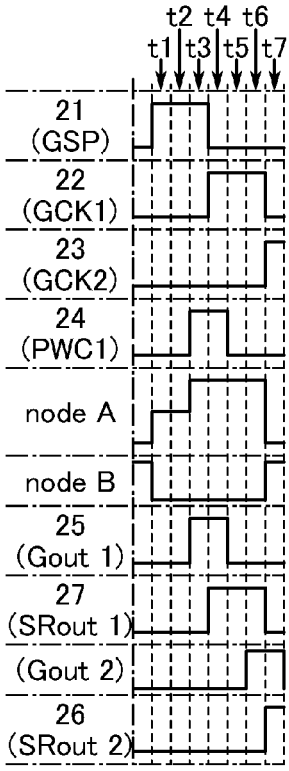
FIGS. 3B to 3D are timing charts showing an operation example of a pulse output circuit.
Figure 3C:
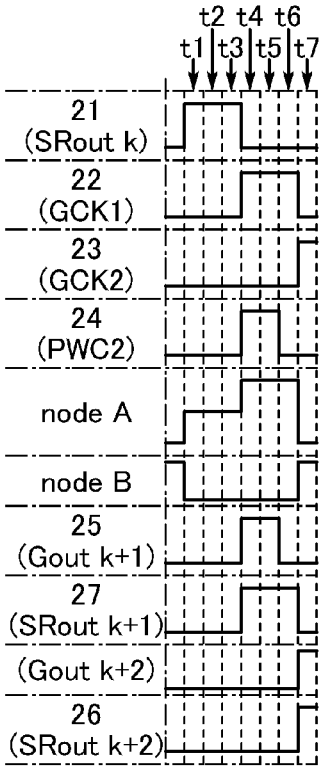
Figure 3D:
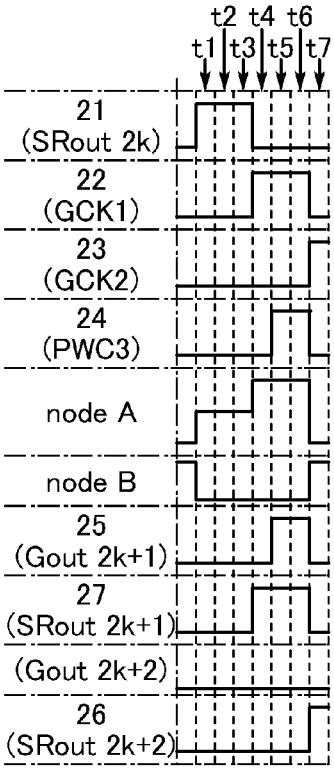

An operation example of the above-described pulse output circuit will be described using FIGS. 3B to 3D. Described in this example is an operation example in the case where timing of inputting the start pulse for a scan line driver circuit to the terminal 21 of the 1st pulse output circuit 20_1 is controlled such that shift pulses are output from the terminals 27 of the 1st pulse output circuit 20_1, the (k+1)-th pulse output circuit 20_(k+1), and the (2k+1)-th pulse output circuit 20_(2k+1) at the same timing. Specifically, the potentials of the signals which are input to the terminals of the 1st pulse output circuit 20_1 and the potentials of the node A and the node B in the case where the start pulse (GSP) is input are shown in FIG. 3B; the potentials of the signals which are input to the terminals of the (k+1)-th pulse output circuit 20_(k+1) and the potentials of the node A and the node B in the case where a high-level signal is input from the k-th pulse output circuit 20_*k* are shown in FIG. 3C; and the potentials of the signals which are input to the terminals of the (2k+1)-th pulse output circuit 20_(2k+1) and the potentials of the node A and the node B in the case where a high-level signal is input from the 2k-th pulse output circuit 20_2k are shown in FIG. 3D. In FIGS. 3B to 3D, the signals which are input to the terminals are each provided in parentheses. In addition, the signal (Gout 2, Gout k+1, Gout 2k+2) which is output from the terminal 25 of the subsequent-stage pulse output circuit (the 2nd pulse output circuit 20_2, the (k+2)-th pulse output circuit 20_(k+2), the (2k+2)-th pulse output circuit 20_(2k+2)), and the output signal of the terminal 27 of the subsequent-stage pulse output circuit (SRout 2: input signal of the terminal 26 of the 1st pulse output circuit 20_1, SRout k+2: input signal of the terminal 26 of the (k+1)-th pulse output circuit 20_(k+1), SRout 2k+2: input signal of the terminal 26 of the (2k+1)-th pulse output circuit 20_(2k+1)) are also shown. In FIGS. 3B and 3D, Gout denotes an output signal from the pulse output circuit to the scan line, and SRout denotes an output signal from the pulse output circuit to the subsequent-stage pulse output circuit.

First, using FIG. 3B, a case where the start pulse for a scan line driver circuit is input to the 1st pulse output circuit 20_1 is described below.

In a period t1, a high-level potential (high power supply potential (Vdd)) is input to the terminal 21 of the 1st pulse output circuit 20_1. Thus, the transistors 31 and 35 are turned on. As a result, the potential of the node A is increased to a high-level potential (a potential that is decreased from the high power supply potential (Vdd) by the threshold voltage of the transistor 31), and the potential of the node B is decreased to the low power supply potential (Vss), so that the transistors 33 and 38 are turned on and the transistors 32, 34, and 39 are turned off. Thus, in the period t1, a signal output from the terminal 27 is a signal input to the terminal 22, and a signal output from the terminal 25 is a signal input to the terminal 24. In this example, in the period t1, both the signal input to the terminal 22 and the signal input to the terminal 24 are the low power supply potential (Vss). Accordingly, in the period t1, the 1st pulse output circuit 20_1 outputs a low-level potential (low power supply potential (Vss)) to the terminal 21 of the 2nd pulse output circuit 20_2 and the scan line in the 1st row in the pixel portion.

In a period t2, the levels of the signals input to the terminals are the same as in the period t1. Therefore, the potentials of the signals output from the terminals 25 and 27 are also not changed: the low-level potentials (low power supply potentials (Vss)) are output.

In a period t3, a high-level potential (high power supply potential (Vdd)) is input to the terminal 24. As a result, the transistor 31 is turned off since the potential of the node A (the potential of the source of the transistor 31) has been increased to the high-level potential (potential that is decreased from the high power supply potential (Vdd) by the threshold voltage of the transistor 31) in the period t1. The input of the high-level potential (high power supply potential (Vdd)) to the terminal 24 further increases the potential of the node A (the potential of the gate of the transistor 38) by capacitive coupling of the source and the gate of the transistor 38 (bootstrapping). Owing to the bootstrapping, the potential of the signal output from the terminal 25 is not decreased from the high-level potential (high power supply potential (Vdd)) input to the terminal 24. Accordingly, in the period t3, the 1st pulse output circuit 20_1 outputs a high-level potential (high power supply potential (Vdd)=a selection signal) to the scan line in the 1st row in the pixel portion.

In a period t4, a high-level potential (high power supply potential (Vdd)) is input to the terminal 22. As a result, since the potential of the node A has been increased by the bootstrapping, the potential of the signal output from the terminal 27 is not decreased from the high-level potential (high power supply potential (Vdd)) input to the terminal 22. Accordingly, in the period t4, the terminal 27 outputs the high-level potential (high power supply potential (Vdd)) which is input to the terminal 22. That is, the 1st pulse output circuit 20_1 outputs a high-level potential (high power supply potential (Vdd)=a shift pulse) to the terminal 21 of the $2^{nd}$ pulse output circuit 20_2. In the period t4 also, the signal input to the terminal 24 is kept at the high-level potential (high power supply potential (Vdd)), so that the signal output to the scan line in the $1^{st}$ row in the pixel portion from the 1st pulse output circuit 20_1 is kept at the high-level potential (high power supply potential (Vdd)=the selection signal). Further, a low-level potential (low power supply potential (Vss)) is input to the terminal 21 to tune off the transistor 35, which does not directly influence the output signals of the 1st pulse output circuit 20_1 in the period t4.

In a period t5, a low-level potential (low power supply potential (Vss)) is input to the terminal 24. In that period, the transistor 38 keeps to be on. Accordingly, in the period t5, the 1st pulse output circuit 20_1 outputs a low-level potential (low power supply potential (Vss)) to the scan line in the 1st row in the pixel portion.

In a period t6, the levels of the signals input to the terminals are the same as in the period t5. Therefore, the potentials of the signals output from the terminals 25 and 27 are also not changed: the low-level potential (low power supply potentials (Vss)) is output from the terminal 25 and the high-level potential (high power supply potential (Vdd)=the shift pulse) is output from the terminal 27.

In a period t7, a high-level potential (high power supply potential (Vdd)) is input to the terminal 23. Thus, the transistor 37 turned on. As a result, the potential of the node B is increased to a high-level potential (a potential that is decreased from the high power supply potential (Vdd) by the threshold voltage of the transistor 37), so that the transistors 32, 34, and 39 are turned on. On the other hand, the potential of the node A is decreased to a low-level potential (low power supply potential (Vss)), so that the transistors 33 and 38 are turned off. Accordingly, in the period t7, both of the signals output from the terminals 25 and 27 are the low power supply potential (Vss). That is, in the period t7, the 1st pulse output circuit 20_1 outputs the low power supply potential (Vss) to the terminal 21 of the 2nd pulse output circuit 20_2 and the scan line in the 1st row in the pixel portion.

Next, using FIG. 3C, signal timing in response to an input of the start pulse for a scan line driver circuit from the k-th pulse output circuit 20_*k* to the second terminal 21 of the (k+1)-th pulse output circuit 20_(k+1) is described below.

Operation of the (k+1)-th pulse output circuit 20_(k+1) is as of the 1st pulse output circuit 20_1 in the periods t1 and t2; thus, the above description is referred to for.

In a period t3, the levels of the signals input to the terminals are the same as in the period t2. Therefore, the potentials of the signals output from the terminals 25 and 27 are also not changed: the low-level potentials (low power supply potentials (Vss)) are output.

In a period t4, high-level potentials (high power supply potentials (Vdd)) are input to the terminals 22 and 24. The transistor 31 is off since the potential of the node A (the potential of the source of the transistor 31) has been increased to the high-level potential (potential that is decreased from the high power supply potential (Vdd) by the threshold voltage of the transistor 31) in the period t1. The input of the high-level potentials (high power supply potentials (Vdd)) to the terminals 22 and 24 further increases the potential of the node A (the potential of the gate of the transistor 33, 38) by capacitive coupling of the source and the gate of the transistor 33, 38 (bootstrapping). Owing to the bootstrapping, the potentials of the signals output from the terminals 25 and 27 are not decreased from the high-level potentials (high power supply potentials (Vdd)) input to the terminals 22 and 24, respectively. Accordingly, in the period t4, the (k+1)-th pulse output circuit 20_(k+1) outputs high-level potentials (high power supply potentials (Vdd)=a selection signal and a shift pulse) to the scan line in the (k+1)-th row in the pixel portion and the terminal 21 of the (k+2)-th pulse output circuit 20_(k+2).

In a period t5, the levels of the signals input to the terminals are the same as in the period t4. Therefore, the potentials of the signals output from the terminals 25 and 27 are also not changed: the high-level potentials (high power supply potentials (Vdd)=the selection signal and the shift pulse) are output.

In a period t6, a low-level potential (low power supply potential (Vss)) is input to the terminal 24. In that period, the transistor 38 keeps to be on. Accordingly, in the period t6, the (k+1)-th pulse output circuit 20_(k+1) outputs a low-level potential (low power supply potential (Vss)) to the scan line in the (k+1)-th row in the pixel portion.

In a period t7, a high-level potential (high power supply potential (Vdd)) is input to the terminal 23. Thus, the transistor 37 turned on. As a result, the potential of the node B is increased to a high-level potential (a potential that is decreased from the high power supply potential (Vdd) by the threshold voltage of the transistor 37), so that the transistors 32, 34, and 39 are turned on. On the other hand, the potential of the node A is decreased to a low-level potential (low power supply potential (Vss)), so that the transistors 33 and 38 are turned off. Accordingly, in the period t7, both of the signals output from the terminals 25 and 27 are the low power supply potential (Vss). That is, in the period t7, the (k+1)-th pulse output circuit 20_(k+1) outputs the low power supply potential (Vss) to the terminal 21 of the (k+2)-th pulse output circuit 20_(k+2) and the scan line in the (k+1)-th row in the pixel portion.

Next, using FIG. 3D, signal timing in response to an input of the start pulse for a scan line driver circuit from the 2k-th pulse output circuit 20_2k to the terminal 21 of the (2k+1)-th pulse output circuit 20_(2k+1) is described below.

Operation of the (2k+1)-th pulse output circuit 20_(2k+1) is as of the (k+1)-th pulse output circuit 20_(k+1) in the periods t1 to t3; thus, the above description is referred to for.

In a period t4, a high-level potential (high power supply potential (Vdd)) is input to the terminal 22. The transistor 31 is off since the potential of the node A (the potential of the source of the transistor 31) has been increased to the high-level potential (potential that is decreased from the high power supply potential (Vdd) by the threshold voltage of the transistor 31) in the period t1. The input of the high-level potential (high power supply potential (Vdd)) to the terminal 22 further increases the potential of the node A (the potential of the gate of the transistor 33) by capacitive coupling of the source and the gate of the transistor 33 (bootstrapping). Owing to the bootstrapping, the potential of the signal output from the terminal 27 is not decreased from the high-level potentials (high power supply potential (Vdd)) input to the terminal 22. Accordingly, in the period t4, the (2k+1)-th pulse output circuit 20_(2k+1) outputs a high-level potential (high power supply potential (Vdd)=a shift pulse) to the terminal 21 of the (2k+2)-th pulse output circuit 20_(2k+2). Further, a low-level potential (low power supply potential (Vss)) is input to the terminal 21 to tune off the transistor 35, which does not directly influence the output signals of the (2k+1)-th pulse output circuit 20_(2k+1) in the period t4.

In a period t5, a high-level potential (high power supply potential (Vdd)) is input to the terminal 24. As a result, since the potential of the node A has been increased by the bootstrapping, the potential of the signal output from the terminal 25 is not decreased from the high-level potential (high power supply potential (Vdd)) input to the terminal 24. Accordingly, in the period t5, the terminal 25 outputs the high-level potential (high power supply potential (Vdd)) which is input to the terminal 24. That is, the (2k+1)-th pulse output circuit 20_(2k+1) outputs a high-level potential (high power supply potential (Vdd)=a selection signal) to the scan line in the (2k+1)-th row in the pixel. In the period t5 also, the signal input to the terminal 22 is kept at the high-level potential (high power supply potential (Vdd)), so that the signal output from the (2k+1)-th pulse output circuit 20_(2k+1) to the output terminal 21 of the (2k+2)-th pulse output circuit 20_(2k+2) is kept at the high-level potential (high power supply potential (Vdd)=the shift pulse).

In a period t6, the levels of the signals input to the terminals are the same as in the period t5. Therefore, the potentials of the signals output from the terminals 25 and 27 are also not changed: the high-level potentials (high power supply potentials (Vdd)=the selection signal and the shift pulse) are output.

In a period t7, a high-level potential (high power supply potential (Vdd)) is input to the terminal 23. Thus, the transistor 37 turned on. As a result, the potential of the node B is increased to a high-level potential (a potential that is decreased from the high power supply potential (Vdd) by the threshold voltage of the transistor 37), so that the transistors 32, 34, and 39 are turned on. On the other hand, the potential of the node A is decreased to a low-level potential (low power supply potential (Vss)), so that the transistors 33 and 38 are turned off. Accordingly, in the period t7, both of the signals output from the terminals 25 and 27 are the low power supply potential (Vss). That is, in the period t7, the (2k+1)-th pulse output circuit 20_(2k+1) outputs the low power supply potential (Vss) to the terminal 21 of the (2k+2)-th pulse output circuit 20_(2k+2) and the scan line in the (2k+1)-th row in the pixel portion.

As shown in FIGS. 3B to 3D, with the 1st pulse output circuit 20_1 to the m-th pulse output circuit 20_*m*, a plurality of shift pulses can be shifted in parallel by controlling the timing at which the start pulse (GSP) for the scan line driver circuit is set to a high-level potential. Specifically, the start pulse (GSP) is reset to the high-level potential at the timing at which the terminal 27 of the k-th pulse output circuit 20_*k* outputs a shift pulse, whereby shift pulses can be output from the 1st pulse output circuit 20_1 and the (k+1)-th pulse output circuit 20_(k+1) at the same timing. The start pulse (GSP) can be further input in a similar manner, whereby shift pulses can be output from the 1st pulse output circuit 20_1, the (k+1)-th pulse output circuit 20_(k+1), and the (2k+1)-th pulse output circuit 20_(2k+1) at the same timing.

In addition, the 1st pulse output circuit 20_1, the (k+1)-th pulse output circuit 20_(k+1), and the (2k+1)-th pulse output circuit 20_(2k+1) can supply selection signals to respective scan lines at different timings in parallel to the above-described operation. That is, with the scan line drive circuit, a plurality of shift pulse can be shifted in parallel, and a plurality of pulse output circuits to which shift pulses are input at the same timing can supply selection signals to their respective scan lines at different timings.

<Structure Example of Signal Line Driver Circuit 12>

Figure 4A:
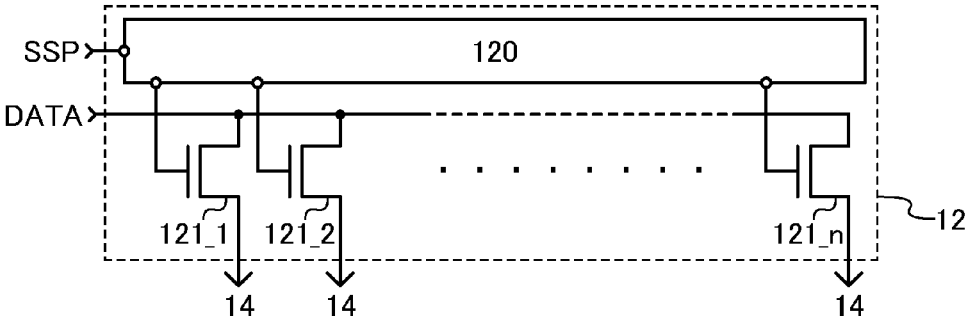
FIG. 4A illustrates a structure example of a signal line driver circuit.

FIG. 4A illustrates a structure example of the signal line driver circuit 12 included in the liquid crystal display device in FIG. 1A. The signal line driver circuit 12 shown in FIG. 4A includes a shift register 120 having 1st to n-th output terminals, a wiring for supplying an image signal (DATA), and transistors 121_1 to 121_*n*. One of a source and a drain of the transistor 121_1 is electrically connected to the wiring for supplying the image signal (DATA), the other of the source and the drain thereof is electrically connected to the signal line in the 1st column in the pixel portion, and a gate thereof is electrically connected to the 1st output terminal of the shift register 120. One of a source and a drain of the transistor 121_*n* is electrically connected to the wiring for supplying the image signal (DATA), the other thereof is electrically connected to the signal line in the n-th column in the pixel portion, and a gate thereof is electrically connected to the n-th output terminal of the shift register 120. The shift register 120 outputs a high-level potential sequentially from the 1st to n-th output terminals per shift period in response to a start pulse for a signal line driver circuit (SSP). That is, the transistors 121_1 to 121_*n* are sequentially turned on per shift period.

Figure 4B:
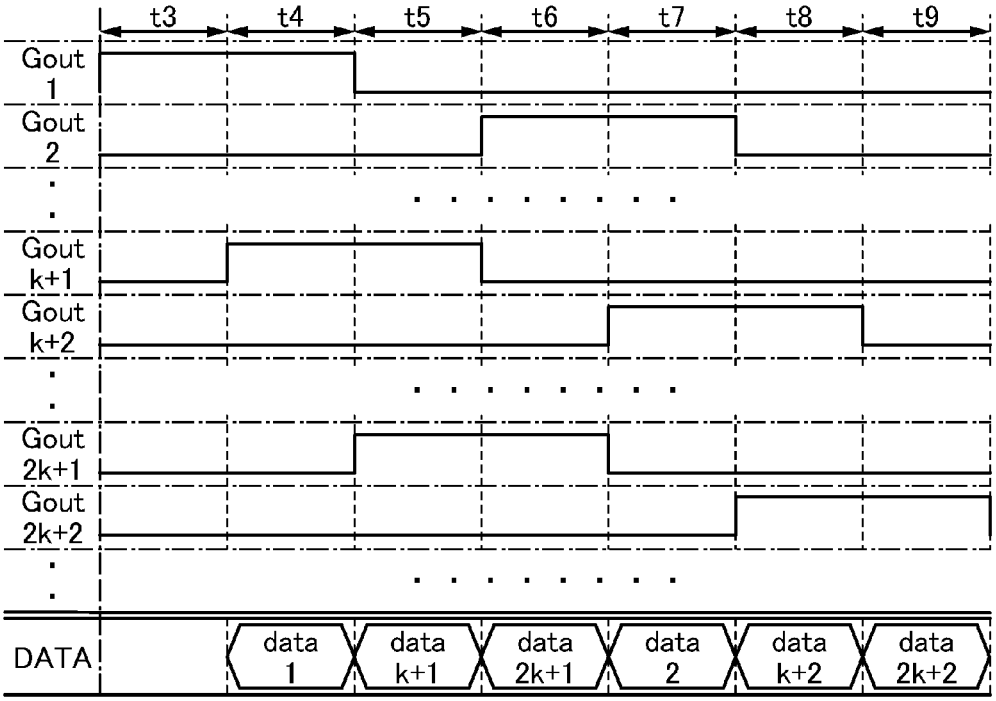
FIG. 4B illustrates an operation example of a signal line driver circuit.

FIG. 4B illustrates timing of image signals which are supplied through the wiring for supplying the image signal (DATA). As shown in FIG. 4B, the wiring for supplying the image signal (DATA) supplies a pixel image signal for the 1st row (data 1) in the period t4; a pixel image signal for the (k+1)-th row (data k+1) in the period t5; a pixel image signal for the (2k+1)-th row (data 2k+1) in the period t6; and a pixel image signal for the 2nd row (data 2) in the period t7. In this manner, the wiring for supplying the image signal (DATA) supplies pixel image signals for respective rows sequentially. Specifically, image signals are supplied in the following order: the pixel image signal for the s-th row (s is a natural number less than k)→the pixel image signal for the (k+s)-th row→the pixel image signal for the (2k+s)-th row→the pixel image signal for the (s+1)-th row. According to the above-described operation of the scan line drive circuit and the signal line driver circuit, image signal writing can be performed on the pixels in three rows in the pixel portion per shift period of the pulse output circuit in the scan line driver circuit.

<Structure Example of Backlight>

Figure 5:
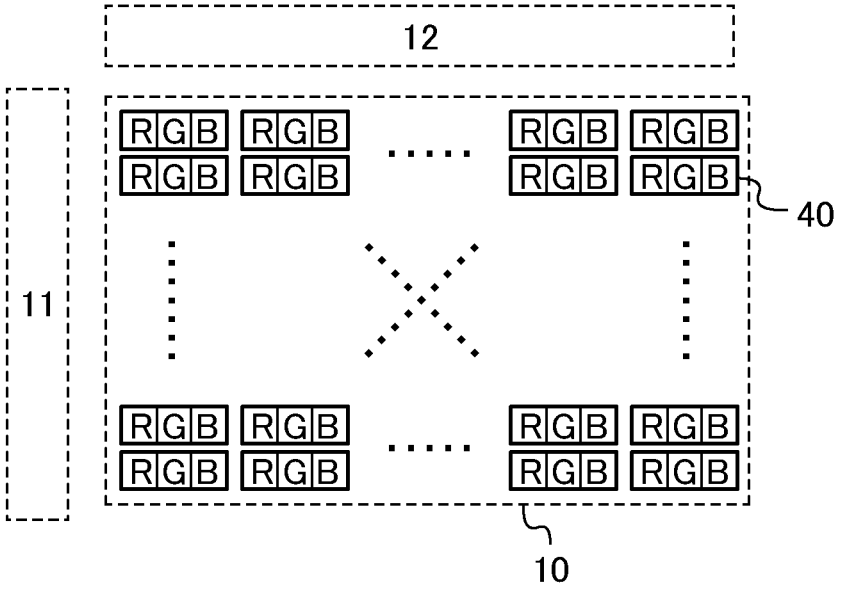
FIG. 5 illustrates a structure example of a backlight.

FIG. 5 illustrates a structure example of a backlight provided behind the pixel portion 10 in the liquid crystal display device illustrated in FIG. 1A. The backlight illustrated in FIG. 5 includes a plurality of backlight units 40 each including light sources of lights with respective colors of red (R), green (G), and blue (B). The plurality of backlight units 40 is arranged in a matrix, and can be controlled to be turned on per unit region. In this example, a backlight unit group is provided at least every matrix of t rows by n columns (here, t is k/4) as the backlight for the plurality of pixels 15 in the matrix of the m rows by the n columns, and lighting of the backlight unit groups can be controlled each individually. In other words, the backlight includes at least a backlight unit group for the 1st to k-th rows to a backlight unit group for the (2k+3t+1)-th to the m-th rows, and lighting of the backlight unit groups can be controlled each individually.

<Operation Example of Liquid Crystal Display Device>

Figure 6:
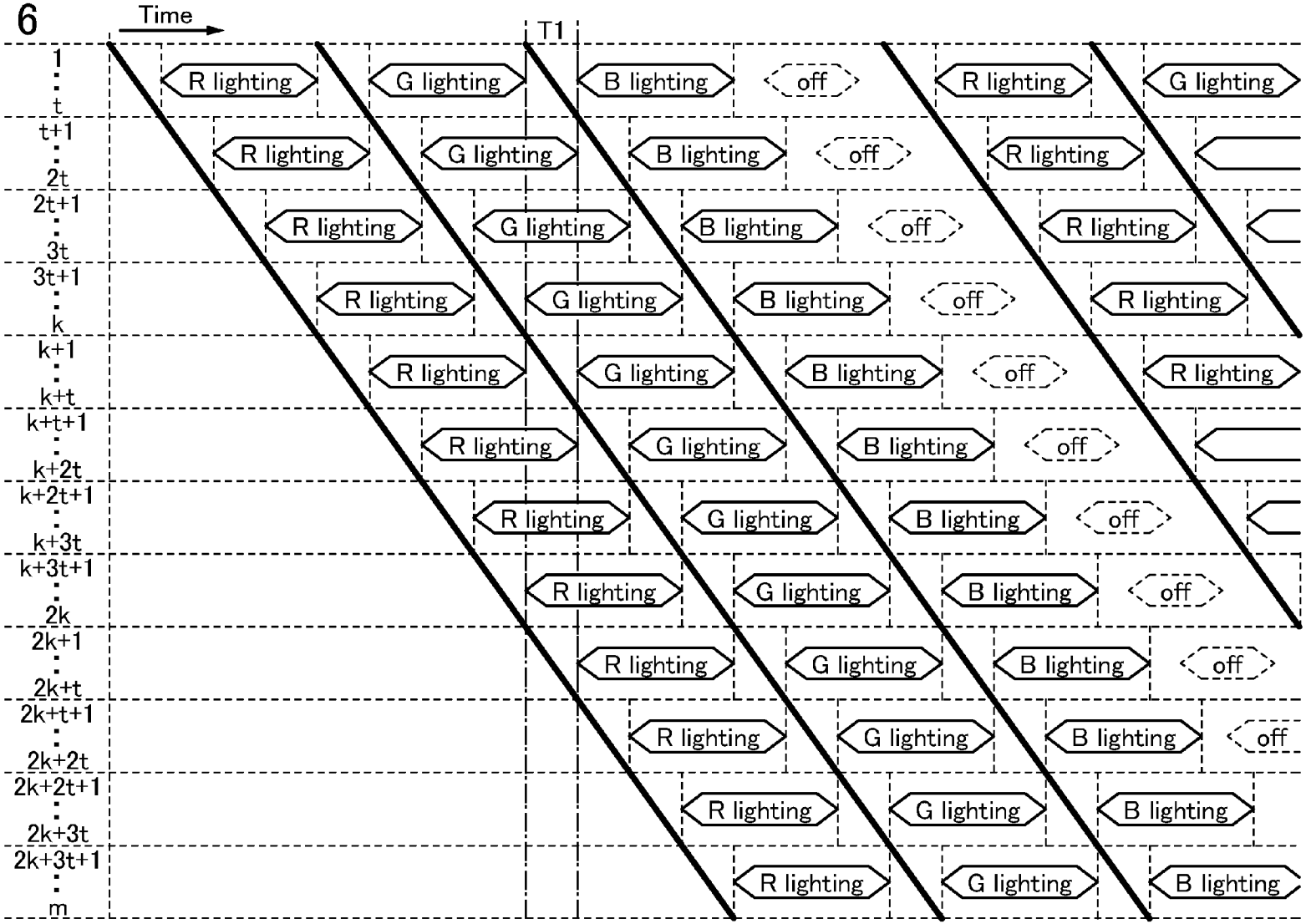
FIG. 6 illustrates an operation example of a liquid crystal display device.

FIG. 6 illustrates timing of lighting the backlight unit group for the 1st to t-th rows to the backlight unit group for the (2k+3t+1)-th to m-th rows that are included in the backlight in the liquid crystal display device and timing of scanning image signals with respect to respective n pixels in the 1st row to the n pixels in the m-th row in the pixel portion 10. Specifically, in FIG. 6, 1 to m each indicate the number of row and solid lines each indicate timing of when the image signal is input in the row. As shown in FIG. 6, in the liquid crystal display device, selection signals can be supplied to the scan lines in the 1st to the m-th rows sequentially not in the row order but every (k+1) rows (e.g., in the following order: the scan line in the 1st row→the scan line in the (k+1)-th row→the scan line in the (2k+1)-th row→the scan line in the 2nd row). Therefore, in a period T1, the n pixels in the 1st row to the n pixels in the t-th row are sequentially selected, the n pixels in the (k+1)-th row to the n pixels in the (k+t)-th row are sequentially selected, and the n pixels 15 in the (2k+1)-th row to the n pixels in the (2k+t)-th row are sequentially selected, so that image signals can be input to the pixels.

Further, in the liquid crystal display device, the backlight can be lit in a period between image signal writings per unit region. That is, in the liquid crystal display device, a round of operation described as follows can be performed not per pixel portion but per unit region in the pixel portion: writing of red (R) image signal (image signal for determining the transmittance of red (R) light of backlight)→lighting of red (R) backlight→writing of green (G) image signal (image signal for determining the transmittance of green (G) light of backlight)→lighting of green (G) backlight→writing of blue (B) image signal (image signal for determining the transmittance of blue (B) light of backlight)→lighting of blue (B) backlight.

Further, in the case where the backlight unit groups are lit as illustrated in FIG. 6, colors of lights of backlight unit groups adjacent to each other are not different from each other. Specifically, when one backlight unit group is lit in a region where image signal writing is performed in the period T1, which follows the image signal writing, the other backlight unit group which is adjacent to the one backlight unit group does not emit light with a different color. For example, in the period T1, when the backlight unit group for the (k+1)-th to (k+t)-th rows emits green (G) light after the green (G) image signals are input to the n pixels in the (k+1)-th row to the n pixels in the (k+t)-th row, green (G) light is emitted or emission itself is not performed (neither red (R) light nor blue (B) light is emitted) in the backlight unit group for the (3t+1)-th to k-th rows and the backlight unit group for the (k+t+1)-th to (k+2t)-th rows. Thus, the probability of transmission of light of a color different from a given color through a pixel to which image data on the given color is input can be reduced.

<Modification Example>

A liquid crystal display device having the above-described structure is one embodiment of the present invention, and a liquid crystal display device the structure of which is different from the above-described structure in some points is included in the present invention.

For example, the above-described liquid crystal display device has a structure where the pixel portion 10 is divided into three regions and image signals are supplied in parallel to the three regions; however, an embodiment of a liquid crystal display device of the present invention is not limited to the structure. That is, an embodiment of a liquid crystal display device of the present invention can have a structure in which the pixel portion 10 is divided into a plurality of regions the number of which is not three and image signals are supplied in parallel to the plurality of regions. In the case where the number of regions is changed, it is necessary to set clock signals for a scan line driver circuit and pulse-width control signals in accordance with the number of regions.

Further, in the above-described liquid crystal display device, the three kinds of light sources emitting respective three lights of red (R), green (G), and blue (B) are included in the backlight unit; however, an embodiment of a liquid crystal display device of the present invention is not limited to this structure. That is, in one embodiment of a liquid crystal display device of the present invention, light sources that emit lights of different colors can be provided in combination to form a backlight unit. For example, in the backlight unit, the following four or three kinds of light sources can be provided in combination: red (R), green (G), blue (B), and white (W); red (R), green (G), blue (B), and yellow (Y); red (R), green (G), blue (B), and cyan (C); red (R), green (G), blue (B), and magenta (M); or cyan (C), magenta (M), and yellow (Y). Further, in the case where four kinds of power sources are combined to form the backlight unit, the pixel portion may be divided into four regions and respective image signals for respective colors can be supplied to the four regions in parallel. Moreover, it is possible to use a combination of six kinds of light sources of pale red (R), pale green (G), pale blue (B), dark red (R), dark green (G), and dark blue (B); or a combination of six kinds of light sources of red (R), green (G), blue (B), cyan (C), magenta (M), and yellow (Y). Further, in the case where six kinds of power sources are combined to form the backlight unit, the pixel portion may be divided into six regions and respective image signals for respective colors can be supplied to the six regions in parallel. In this manner, with a combination of lights of a number of kinds of colors to form an image, the color gamut of the liquid crystal display device can be enlarged, and the image quality can be improved.

Figure 10:
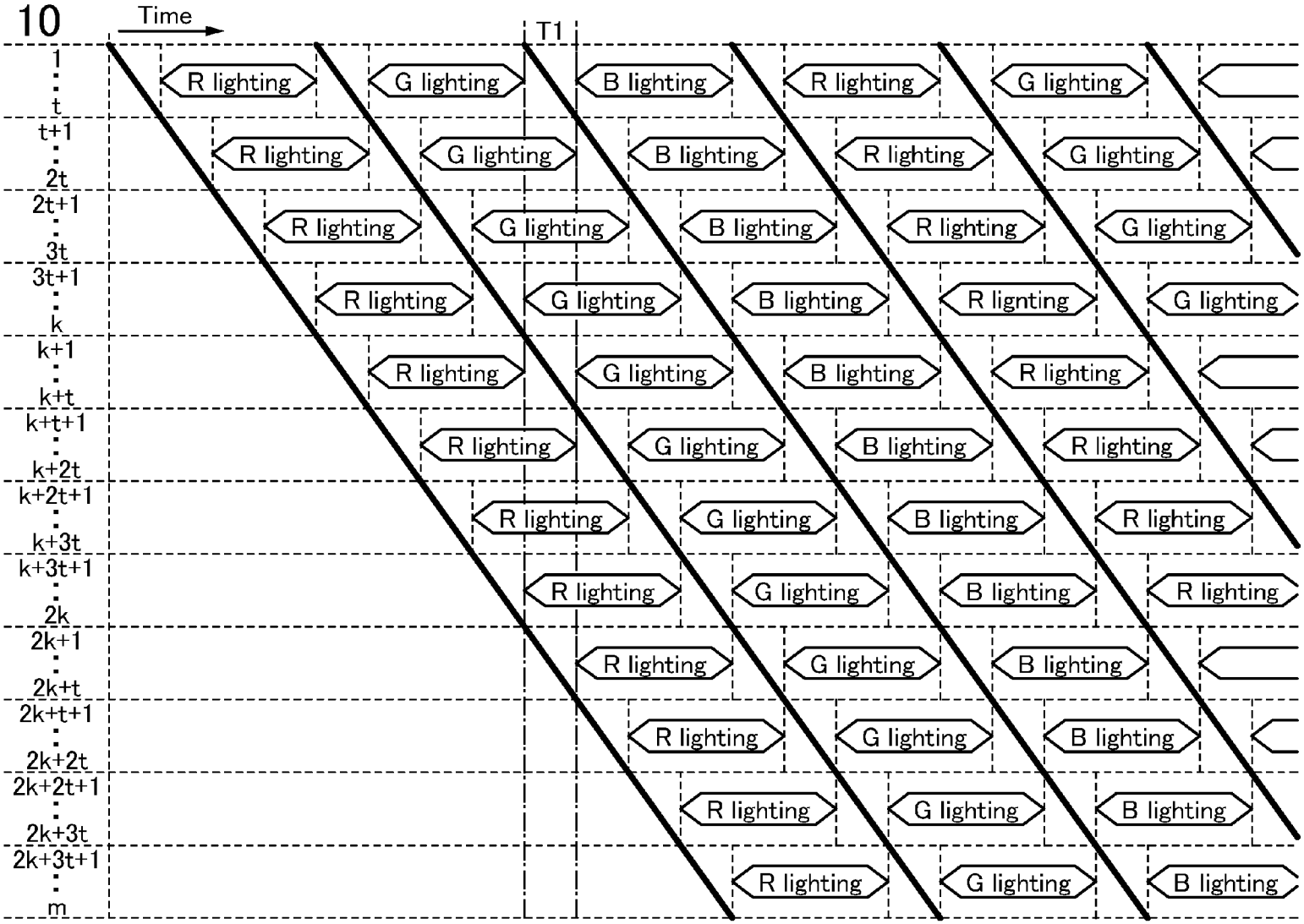
FIG. 10 illustrates an operation example of a liquid crystal display device.
Figure 11:
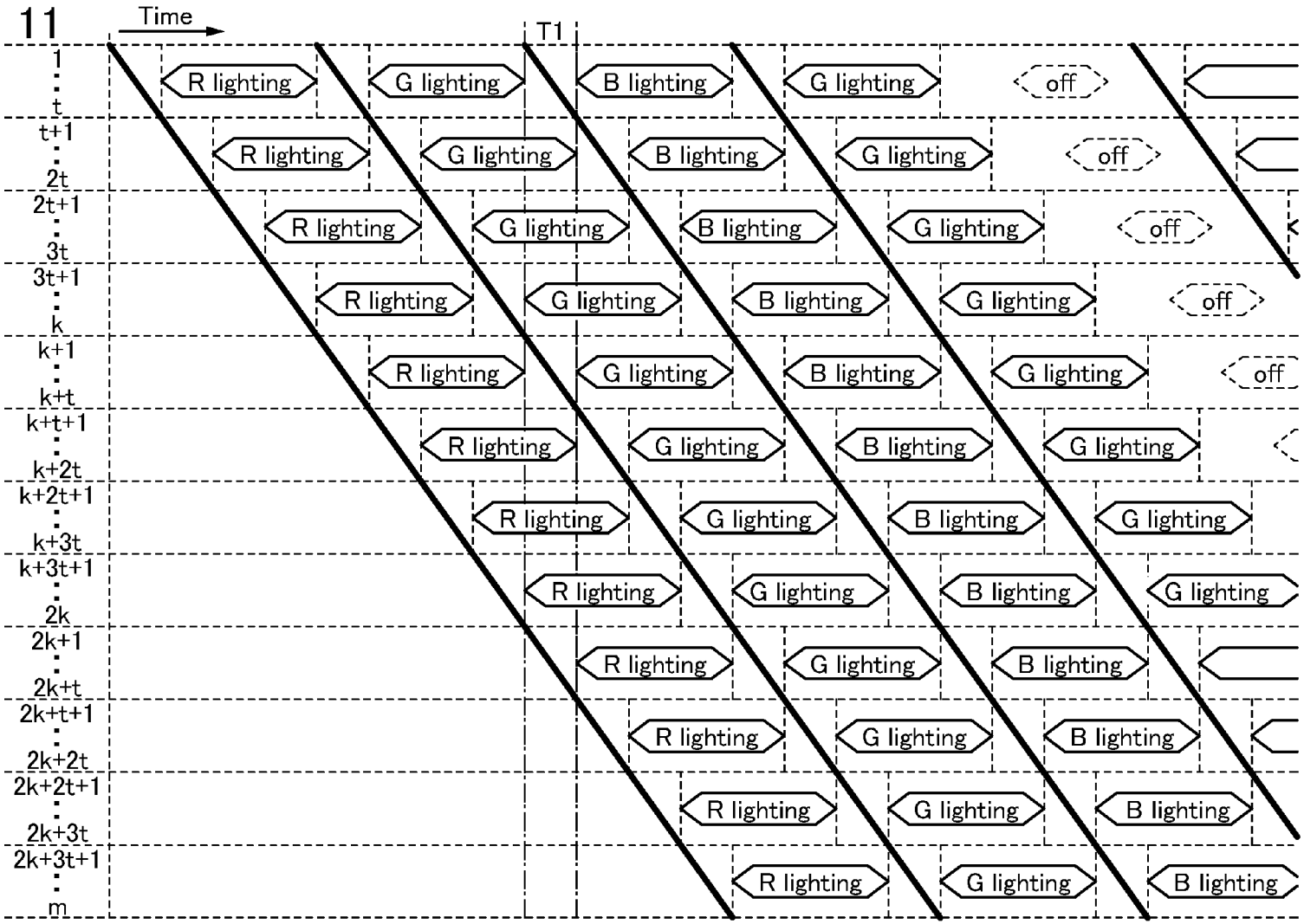
FIG. 11 illustrates an operation example of a liquid crystal display device.

Further, in the above-described liquid crystal display device, a period in which all of the light sources included in the backlight unit group are off is provided every after lighting of the blue (B) light source (see FIG. 6); alternatively, a series of lighting of the red (R) light source, lighting of the green (G) light source, and lighting of the blue (B) light source may be consecutively repeated without interposing such a period in which all of the light sources included in the backlight unit group are off (see FIG. 10).

Further, in the above-described liquid crystal display device, one image is formed in the pixel portion by one lighting of the red (R) light source, one lighting of the green (G) light source, and one lighting of the blue (B) light source (see FIG. 6); alternatively, at least one of the plurality of light sources may be lit at least one more time for formation of one image in the pixel portion. For example, the green (G) light source whose light exhibits high luminosity factor may be lit twice for formation of one image in the pixel portion (see FIG. 11). In that case, the lighting frequency of the green (G) light source whose light exhibits high luminosity factor can be increased, which enables generation of flickers to be suppressed.

The above-described liquid crystal display device includes a capacitor for retaining voltage applied to a liquid crystal element (see FIG. 1B); however, it is possible not to include the capacitor.

Figure 7A:
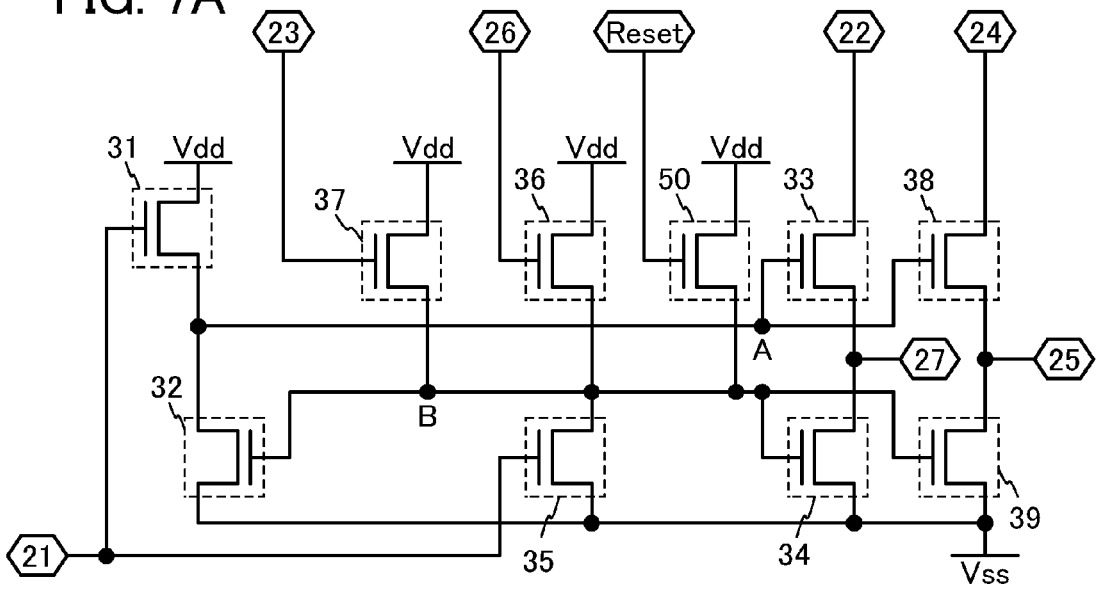
FIGS. 7A and 7B are circuit diagrams illustrating examples of a pulse output circuit.

Further, the pulse output circuit can have a structure in which a transistor 50 is added to the pulse output circuit illustrated in FIG. 3A (see FIG. 7A). One of a source and a drain of the transistor 50 is electrically connected to the high power supply potential line; the other of the source and the drain of the transistor 50 is electrically connected to the gate of the transistor 32, the gate of the transistor 34, the other of the source and the drain of the transistor 35, the other of the source and the drain of the transistor 36, the other of the source and the drain of the transistor 37, and the gate of the transistor 39; and a gate of the transistor 50 is electrically connected to a reset terminal (Reset). To the reset terminal, a high-level potential is input in a period which follows a series of operation from red (R) image signal writing to lighting of blue (B) backlight; a low-level potential is input in the other period. That is, the transistor 50 is turned on in that period where the high-level potential is input to the reset terminal. Thus, the potential of each node can be initialized in that period, so that malfunction can be prevented.

Figure 7B:
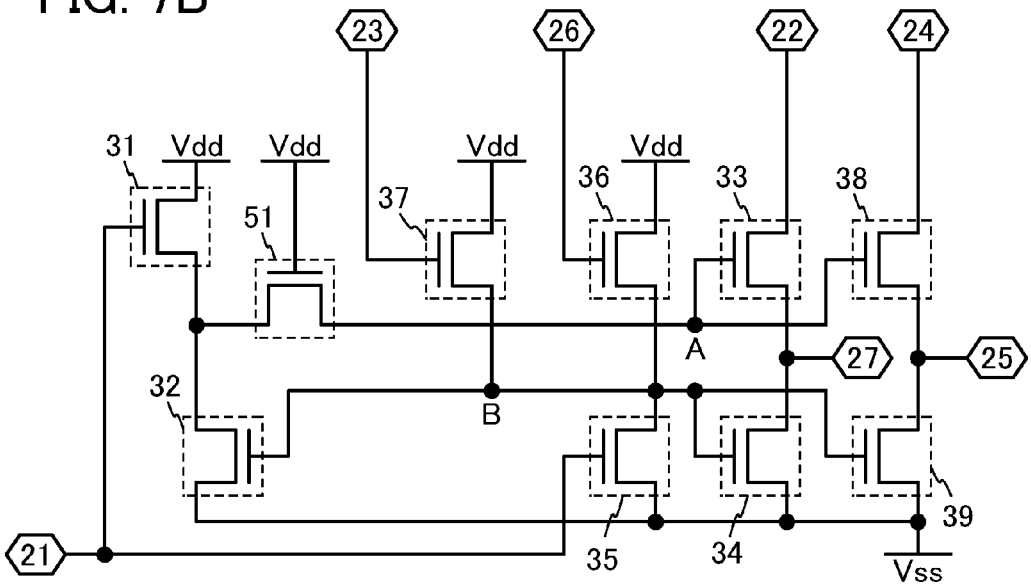

Further alternatively, the pulse output circuit can have a structure in which a transistor 51 is added to the pulse output circuit illustrated in FIG. 3A (see FIG. 7B). One of a source and a drain of the transistor 51 is electrically connected to the other of the source and the drain of the transistor 31 and the other of the source and the drain of the transistor 32; the other of the source and the drain thereof is electrically connected to the gate of the transistor 33 and the gate of the transistor 38; and a gate of the transistor 51 is electrically connected to the high power supply potential line. The transistor 51 is turned off in a period during which the potential of the node A is at a high level (the periods t1 to t6 in FIGS. 3B to 3D). With the transistor 51, the gate of the transistor 33 and the gate of the transistor 38 can be electrically disconnected to the other of the source and the drain of the transistor 31 and the other of the source and the drain of the transistor 32 in the periods t1 to t6. Thus, a load at the time of the bootstrapping in the pulse output circuit can be reduced in the periods t1 to t6.

Figure 8A:
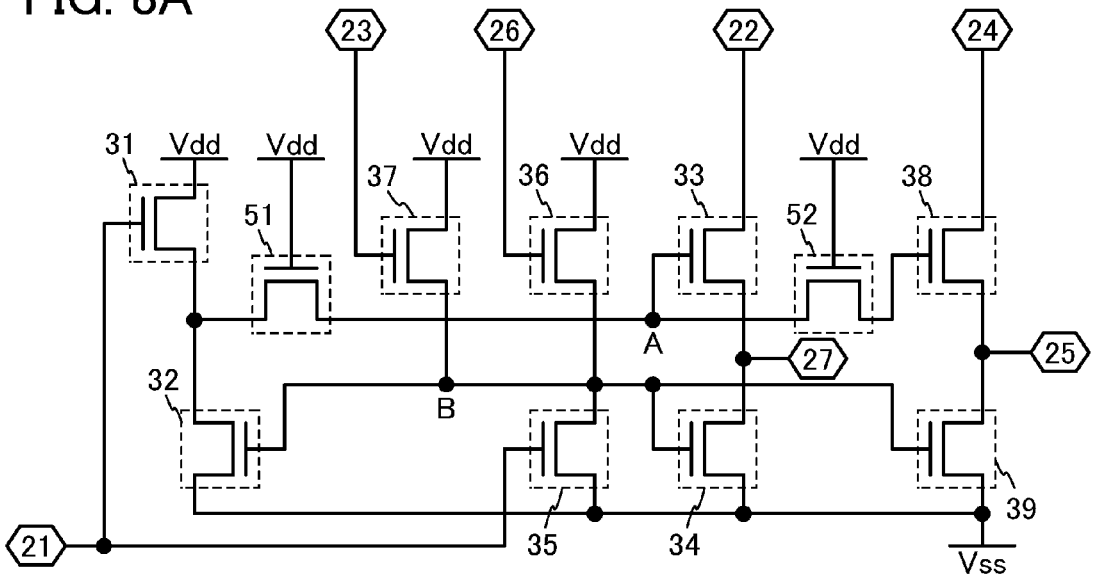
FIGS. 8A and 8B are circuit diagrams illustrating examples of a pulse output circuit.

Further alternatively, the pulse output circuit can have a structure in which a transistor 52 is added to the pulse output circuit illustrated in FIG. 7B (see FIG. 8A). One of a source and a drain of the transistor 52 is electrically connected to the gate of the transistor 33 and the other of the source and the drain of the transistor 51; the other of the source and the drain of the transistor 52 is electrically connected to the gate of the transistor 38; and a gate of the transistor 52 is electrically connected to the high power supply potential line. As described above, a load at the time of the bootstrapping in the pulse output circuit can be reduced with the transistor 52. In particular, the load-reduction effect is large in the case where the potential of the node A is increased only by the capacitive coupling of the source and the gate of the transistor 33 (see FIG. 3D).

Figure 8B:
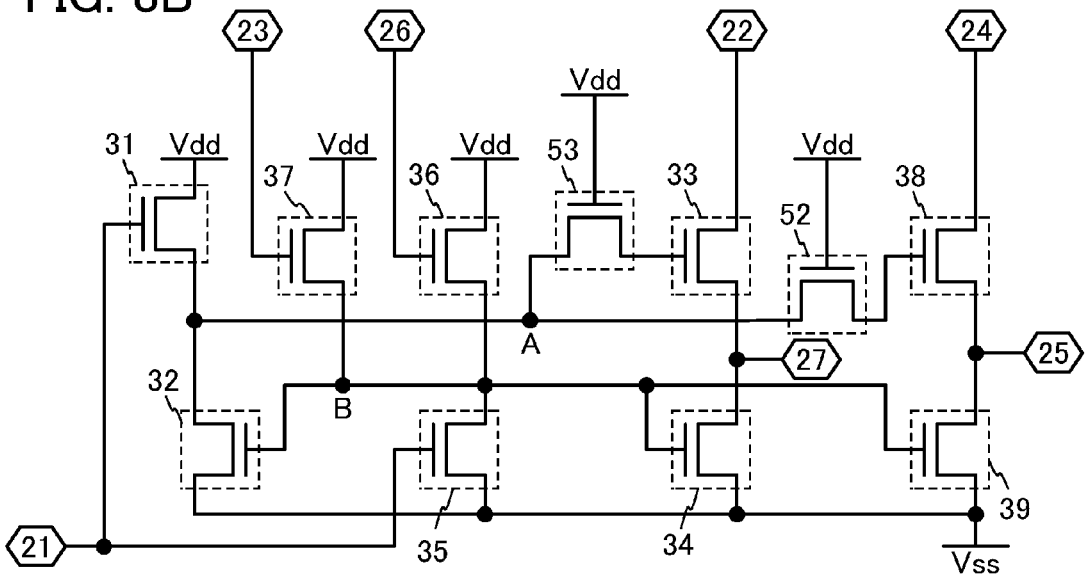

Further alternatively, the pulse output circuit can have a structure in which the transistor 51 is removed from the pulse output circuit shown in FIG. 8A and a transistor 53 is added to the pulse output circuit shown in FIG. 8A (see FIG. 8B). One of a source and a drain of the transistor 53 is electrically connected to the other of the source and the drain of the transistor 31, the other of the source and the drain of the transistor 32, and one of the source and the drain of the transistor 52; the other of the source and the drain of the transistor 53 is electrically connected to the gate of the transistor 33; and a gate of the transistor 53 is electrically connected to the high power supply potential line. As described above, with the transistor 53, a load at the time of the bootstrapping in the pulse output circuit can be reduced. Further, an effect of a fraud pulse generated in the pulse output circuit on the switching of the transistors 33 and 38 can be decreased.

Further, in the liquid crystal display device, the three kinds of light sources of respective lights of three colors of red (R), green (G), and blue (B) are aligned linearly and horizontally as the backlight unit (see FIG. 5); however, the structure of the backlight unit is not limited to this. For example, the three kinds of light sources may be arranged triangularly, or linearly and longitudinally; or a red (R) backlight unit, a green (G) backlight unit, and a blue (B) backlight unit may be provided each individually. Moreover, the above-described liquid crystal display device is provided with a direct-lit backlight as the backlight (see FIG. 5); alternatively, an edge-lit backlight can be used as the backlight.

<Various Kinds of Electronic Devices Having Liquid Crystal Display Device>

Examples of electronic devices each having the liquid crystal display device disclosed in this specification will be described below using FIGS. 9A to 9F.

Figure 9A:
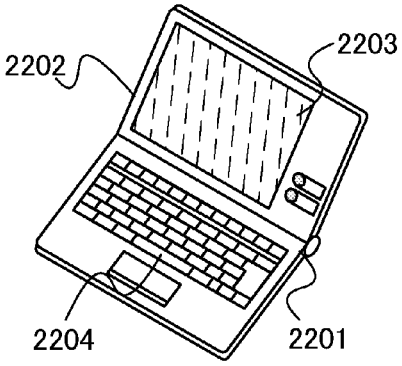
FIGS. 9A to 9F illustrate examples of an electronic device.

FIG. 9A illustrates a laptop personal computer, which includes a main body 2201, a housing 2202, a display portion 2203, a keyboard 2204, and the like.

Figure 9B:
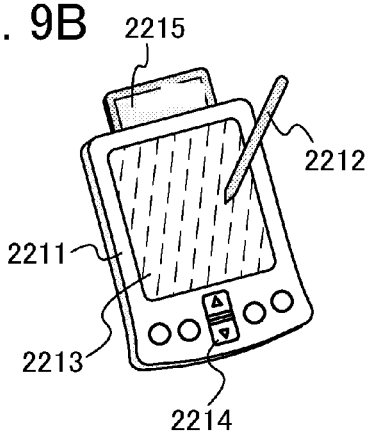

FIG. 9B illustrates a portable information terminal (PDA), which includes a main body 2211 provided with a display portion 2213, an external interface 2215, operation buttons 2214, and the like. A stylus 2212 for operation is included as an accessory.

Figure 9C:
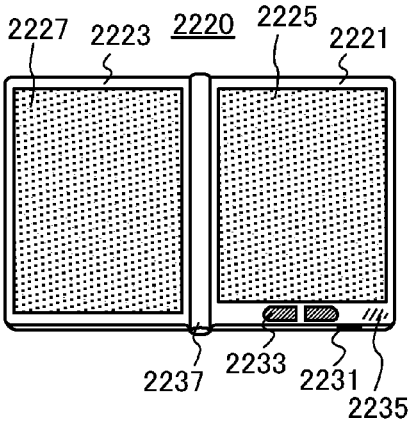

FIG. 9C illustrates an e-book reader. An e-book reader 2220 includes two housings, a housing 2221 and a housing 2223. The housings 2221 and 2223 are bound with each other by an axis portion 2237, along which the e-book reader 2220 can be opened and closed. With such a structure, the e-book reader 2220 can be used as paper books.

A display portion 2225 is incorporated in the housing 2221, and a display portion 2227 is incorporated in the housing 2223. The display portion 2225 and the display portion 2227 may display one image or different images. In the structure where the display portions display different images, for example, the right display portion (the display portion 2225 in FIG. 9C) can display text and the left display portion (the display portion 2227 in FIG. 9C) can display images.

Further, in FIG. 9C, the housing 2221 is provided with an operation portion and the like. For example, the housing 2221 is provided with a power supply 2231, an operation key 2233, a speaker 2235, and the like. With the operation key 2223, pages can be turned. A keyboard, a pointing device, or the like may also be provided on the surface of the housing, on which the display portion is provided. Furthermore, an external connection terminal (an earphone terminal, a USB terminal, a terminal that can be connected to various cables such as an AC adapter and a USB cable, or the like), a recording medium insertion portion, and the like may be provided on the back surface or the side surface of the housing. Further, the e-book reader 2220 may be equipped with a function of an electronic dictionary.

The e-book reader 2220 may be configured to transmit and receive data wirelessly. Through wireless communication, book data or the like can be purchased and downloaded from an electronic book server.

Figure 9D:
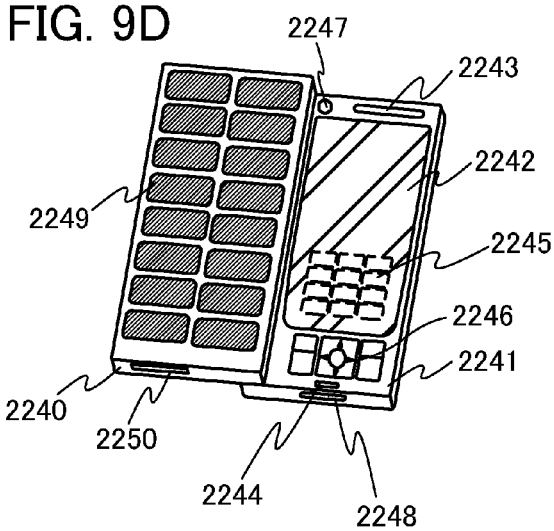

FIG. 9D illustrates a mobile phone. The mobile phone includes two housings: housings 2240 and 2241. The housing 2241 is provided with a display panel 2242, a speaker 2243, a microphone 2244, a pointing device 2246, a camera lens 2247, an external connection terminal 2248, and the like. The housing 2240 is provided with a solar cell 2249 charging of the mobile phone, an external memory slot 2250, and the like. An antenna is incorporated in the housing 2241.

The display panel 2242 has a touch panel function. A plurality of operation keys 2245 which is displayed as images is illustrated by dashed lines in FIG. 9D. Note that the mobile phone includes a booster circuit for increasing a voltage output from the solar cell 2249 to a voltage needed for each circuit. Moreover, the mobile phone can include a contactless IC chip, a small recording device, or the like in addition to the above structure.

The display orientation of the display panel 2242 changes as appropriate in accordance with the application mode. Further, the camera lens 2247 is provided on the same surface as the display panel 2242, which enables a video phone. The speaker 2243 and the microphone 2224 can be used for videophone calls, recording, and playing sound, etc. as well as voice calls. Moreover, the housings 2240 and 2241 in a state where they are developed as illustrated in FIG. 9D can be slid so that one is lapped over the other; therefore, the size of the mobile phone can be reduced, which makes the mobile phone suitable for being carried.

The external connection terminal 2248 can be connected to an AC adapter or a variety of cables such as a USB cable, which enables charging of the mobile phone and data communication. Moreover, a larger amount of data can be saved and moved with a recording medium which is inserted to the external memory slot 2250. Further, in addition to the above functions, an infrared communication function, a television reception function, or the like may be provided.

Figure 9E:
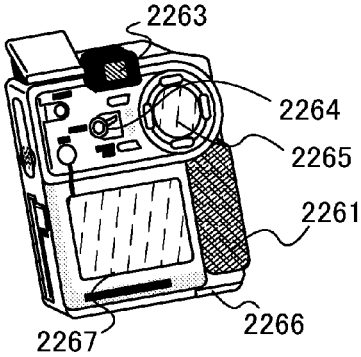

FIG. 9E illustrates a digital camera. The digital camera includes a main body 2261, a display portion (A) 2267, an eyepiece 2263, an operation switch 2264, a display portion (B) 2265, a battery 2266, and the like.

Figure 9F:
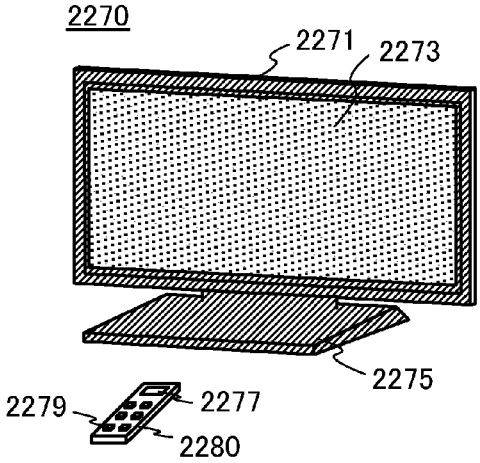

FIG. 9F illustrates a television set. In a television set 2270, a display portion 2273 is incorporated in a housing 2271. The display portion 2273 can display images. In FIG. 9F, the housing 2271 is supported by a stand 2275.

The television set 2270 can be operated by an operation switch of the housing 2271 or a separate remote controller 2280. Channels and volume can be controlled with an operation key 2279 of the remote controller 2280 so that an image displayed on the display portion 2273 can be controlled. Moreover, the remote controller 2280 may have a display portion 2227 in which the information outgoing from the remote controller 2280 is displayed.

Note that the television set 2270 is preferably provided with a receiver, a modem, and the like. A general television broadcast can be received with the receiver. Moreover, when the television set is connected to a communication network with or without wires via the modem, one-way (from a sender to a receiver) or two-way (between a sender and a receiver or between receivers) data communication can be performed.

EXPLANATION OF REFERENCE

10: pixel portion; 11: scan line driver circuit; 12: signal line driver circuit; 13: scan line; 14: signal line; 15: pixel; 16: transistor; 17: capacitor; 18: liquid crystal element; **20_1~20_*m*: pulse output circuit; 21~27: terminal; 31~39: transistor; 40: backlight unit; 50~53: transistor; 101~103: region; 120: shift register; 121_1~121_*n*: transistor; 2201: main body; 2202: housing; 2203: display portion; 2204: keyboard; 2211: main body; 2212: stylus; 2213: display portion; 2214: operation button; 2215: external interface; 2220: e-book; 2221: housing; 2223: housing; 2225: display portion; 2227: display portion; 2231: power supply; 2233: operation key; 2235: speaker; 2237: axis portion; 2240: housing; 2241: housing; 2242: display panel; 2243: speaker; 2244: microphone; 2245: operation key; 2246: pointing device; 2247: camera lens; 2248: external connection terminal; 2249: solar battery cell; 2250: external memory slot; 2261: main body; 2263: eyepiece portion; 2264: operation switch; 2265: display portion (B); 2266: battery; 2267: display portion (A); 2270: television set; 2271: housing; 2273: display portion; 2275: stand; 2277: display portion; 2279: operation key; 2280**: remote controller This application is based on Japanese Patent Application serial no. 2010-119070, 2010-181500, and 2010-281575 filed with Japan Patent Office on May 25, 2010, Aug. 16, 2010, and Dec. 17, 2010, respectively, the entire contents of which are hereby incorporated by reference.

The invention claimed is:

1. A liquid crystal display device comprising:

a plurality of pixels arranged in a matrix of m rows by n columns (m and n are natural numbers greater than or equal to 2);

1st to m-th scan lines which are electrically connected to respective n pixels in their respective rows;

1st to n-th signal lines which are electrically connected to respective m pixels in their respective columns;

a scan line driver circuit which is electrically connected to the 1st to m-th scan lines; and a signal line driver circuit which is electrically connected to the 1st to n-th signal lines, wherein the scan line driver circuit includes 1st to m-th pulse output circuits which shift a shift pulse sequentially per shift period in response to a start pulse, wherein an A-th pulse output circuit (A is a natural number less than or equal to m/2) comprises a 1st output terminal for outputting a shift pulse to an (A+1)-th pulse output circuit during an A-th shift period and a 2nd output terminal for outputting a selection signal to an A-th scan line in an A-th scan line selection period which overlaps with the A-th shift period, wherein an (A+B)-th pulse output circuit (8 is a natural number less than or equal to m/2) comprises a 1st output terminal for outputting a shift pulse to an (A+B+1)-th pulse output circuit during the A-th shift period and a 2nd output terminal for outputting a selection signal to an (A+B)-th scan line in an (A+B)-th scan line selection period which overlaps with the A-th shift period, wherein the signal line driver circuit supplies a pixel image signal for an A-th row to the 1st to n-th signal lines in a first period which overlaps with the A-th scan line selection period, wherein the signal line driver circuit supplies a pixel image signal for an (A+B)-th row to the 1st to n-th signal lines in a second period which overlaps with the (A+B)-th scan line selection period, and wherein the first period and the second period do not overlap with each other.

2. The liquid crystal display device according to claim 1, wherein at least one of the pixels comprises a transistor.

3. The liquid crystal display device according to claim 2, wherein the at least one of the pixels comprises a pixel electrode connected with one of a source and a drain of the transistor.

4. The liquid crystal display device according to claim 1, wherein the liquid crystal display device is incorporated into one selected from the group consisting of a computer, a portable information terminal, an e-book reader, a mobile phone, a camera, and a television set.

5. The liquid crystal display device according to claim $1_1$ further comprising:

a plurality of backlight units provided behind the matrix, wherein each of the backlight units includes light sources with a plurality of colors.

6. The liquid crystal display device according to claim 1, further comprising:

a plurality of backlight units provided behind the matrix, wherein each of the backlight units includes a red light source, a green light source, and a blue light source.

7. The liquid crystal display device according to claim 5, wherein a backlight unit group is provided in every matrix comprising n columns.

8. The liquid crystal display device according to claim 5, wherein a plurality of backlight unit groups are provided behind a pixel portion comprising the plurality of pixels arranged in the matrix of m rows by n columns, and each of the backlight unit groups is provided in every matrix comprising n columns, and wherein the color of the light source which is selected initially in each of the backlight unit groups is the same.

9. The liquid crystal display device according to claim 1, further comprising:

a plurality of backlight units provided behind the matrix, wherein each of the backlight units includes a red light source, a green light source, a blue light source, and a white light source.

10. The liquid crystal display device according to claim 1, further comprising:

a plurality of backlight units provided behind the matrix, wherein each of the backlight units includes a red light source, a green light source, a blue light source, and a yellow light source.

11. The liquid crystal display device according to claim 1, further comprising:

a plurality of backlight units provided behind the matrix, wherein each of the backlight units includes a red light source, a green light source, a blue light source, and a cyan light source.

12. The liquid crystal display device according to claim 1, further comprising:

a plurality of backlight units provided behind the matrix, wherein each of the backlight units includes a red light source, a green light source, a blue light source, and a magenta light source.

13. The liquid crystal display device according to claim 1, further comprising:

a plurality of backlight units provided behind the matrix, wherein each of the backlight units includes a cyan light source, a magenta light source, and a yellow light source.

14. The liquid crystal display device according to claim 3, wherein the other of the source and the drain of the transistor is connected with corresponding one of the 1st to n-th signal lines.

15. A method for driving a liquid crystal display device including a plurality of pixels arranged in a matrix of m rows by n columns (m and n are natural numbers greater than or equal to 2), the method comprising the steps of:

supplying a first shift pulse from an A-th pulse output circuit to an (A+1)-th pulse output circuit during an A-th shift period (A is a natural number less than or equal to m/2), supplying a first selection signal from the A-th pulse output circuit to an A-th scan line in an A-th scan line selection period which overlaps with the A-th shift period, supplying a second shift pulse from an (A+B)-th pulse output circuit to an (A+B+1)-th pulse output circuit during the A-th shift period (B is a natural number less than or equal to m/2), supplying a second selection signal from the (A+B)-th pulse output circuit to an (A+B)-th scan line in an (A+B)-th scan line selection period which overlaps with the A-th shift period, supplying a pixel image signal for an A-th row from a signal line driver circuit to the 1st to n-th signal lines in a first period which overlaps with the A-th scan line selection period, and supplying a pixel image signal for an (A+B)-th row from the signal line driver circuit to the 1st to n-th signal lines in a second period which overlaps with the (A+B)-th scan line selection period, wherein the first period and the second period do not overlap with each other.

16. The method for driving a liquid crystal display device according to claim 15, wherein the liquid crystal display device is incorporated into one selected from the group consisting of a computer, a portable information terminal, an e-book reader, a mobile phone, a camera, and a television set.

17. The method for driving a liquid crystal display device according to claim 15, wherein at least one of the pixels comprises a transistor.

18. The method for driving a liquid crystal display device according to claim 17, wherein the at least one of the pixels comprises a pixel electrode connected with one of a source and a drain of the transistor.

* * * * *

UNITED STATES PATENT AND TRADEMARK OFFICE

CERTIFICATE OF CORRECTION

PATENT NO. : 8,564,629 B2
APPLICATION NO. : 13/112338
DATED : October 22, 2013
INVENTOR(S) : Kouhei Toyotaka et al.

It is certified that error appears in the above-identified patent and that said Letters Patent is hereby corrected as shown below:

In the Claims:

In claim 1, at column 18, line 49, “8” should be --B--.

Signed and Sealed this
Seventeenth Day of December, 2013

Margaret A. Focarino

Margaret A. Focarino
*Commissioner for Patents of the United States Patent and Trademark Office*